US010261443B2

(12) United States Patent
Fujiwara et al.

(10) Patent No.: US 10,261,443 B2
(45) Date of Patent: Apr. 16, 2019

(54) DEVELOPER CONTAINER, DEVELOPING APPARATUS, PROCESS CARTRIDGE AND IMAGE FORMING APPARATUS

(71) Applicant: CANON KABUSHIKI KAISHA, Tokyo (JP)

(72) Inventors: Akihiro Fujiwara, Mishima (JP); Tsukasa Abe, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/793,059

(22) Filed: Oct. 25, 2017

(65) Prior Publication Data

US 2018/0120738 A1 May 3, 2018

(30) Foreign Application Priority Data

Oct. 31, 2016 (JP) ..... 2016-212463

(51) Int. Cl.
*G03G 15/08* (2006.01)

(52) U.S. Cl.
CPC ..... *G03G 15/0889* (2013.01); *G03G 15/087* (2013.01); *G03G 15/0836* (2013.01); *G03G 15/0808* (2013.01); *G03G 15/0875* (2013.01); *G03G 2215/085* (2013.01)

(58) Field of Classification Search
CPC ..... G03G 15/0889; G03G 15/0836; G03G 15/0875; G03G 15/0808; G03G 2215/085
See application file for complete search history.

(56) References Cited

U.S. PATENT DOCUMENTS 7,860,437 B2 12/2010 Kakuta et al.
8,185,023 B2 5/2012 Kakuta et al.
8,208,838 B2 * 6/2012 Kakuta ..... G03G 15/0844 399/262
8,532,544 B2 9/2013 Kakuta et al.
9,310,713 B2 4/2016 Maeshima et al.
(Continued)

FOREIGN PATENT DOCUMENTS

JP 2008-170951 A 7/2008
JP 2010-190978 A 9/2010
(Continued)

OTHER PUBLICATIONS

Japanese Office Action dated May 22, 2018, in related Japanese Patent Application No. 2016-212463.

*Primary Examiner* — Gregory H Curran
(74) *Attorney, Agent, or Firm* — Venable LLP

(57) ABSTRACT

A developer container includes a first sheet member installed on a rotation shaft disposed in a developer containing portion and transporting the developer to a developer carrying member, and a second sheet member installed on the rotation shaft and rotating in the same phase as the first sheet member. One end of the first sheet member and one end of the second sheet member are fixed to the rotation shaft so as to rotate in the same phase, and the other ends of the first and second sheet members are free ends. When the rotation shaft rotates in a state in which at least a part of the developer elevated by the first sheet member is positioned above the rotation shaft, the second sheet member rotates on the downstream side of the first sheet member, so as to control falling of developer on the first sheet member.

28 Claims, 11 Drawing Sheets

(56) References Cited

U.S. PATENT DOCUMENTS

| | | | | |
|---|---|---|---|---|
| 9,594,342 | B2 | 3/2017 | Fujiwara et al. | |
| 9,599,955 | B2 | 3/2017 | Hirukawa et al. | |
| 9,811,025 | B2 | 11/2017 | Abe et al. | |
| 2013/0259530 | A1* | 10/2013 | Kato | G03G 15/0832 399/254 |
| 2016/0252848 | A1* | 9/2016 | Abe | G03G 15/0891 399/254 |
| 2017/0160674 | A1 | 6/2017 | Hirukawa et al. | |
| 2018/0039204 | A1 | 2/2018 | Abe et al. | |

FOREIGN PATENT DOCUMENTS

| | | | |
|---|---|---|---|
| JP | 2010-197972 | A | 9/2010 |
| JP | 2011-039554 | A | 2/2011 |
| JP | 2014-006333 | A | 1/2014 |
| JP | 2014-044343 | A | 3/2014 |
| JP | 2014-062993 | A | 4/2014 |
| JP | 2015-200867 | A | 11/2015 |
| JP | 2016-161717 | A | 9/2016 |

* cited by examiner

DEVELOPER CONTAINER, DEVELOPING APPARATUS, PROCESS CARTRIDGE AND IMAGE FORMING APPARATUS

BACKGROUND OF THE INVENTION

Field of the Invention

The present invention relates to a developer container to contain developer which is used for forming an image on a recording medium, and relates to a developing apparatus that develops an electrostatic latent image formed on a photosensitive drum. Further, the present invention relates to a process cartridge that forms a developer image on a photosensitive drum, and is attachable to and detachable from the main body of an image forming apparatus, and relates to an image forming apparatus that forms an image on a recording medium using developer.

Description of the Related Art

In the case of an image forming apparatus, such as a printer, which uses an electro-photographic image forming system (electro-photographic process), a photosensitive drum is uniformly charged by a charging roller first when an image is formed on a recording material. Then the charged photosensitive drum is selectively exposed by an exposing apparatus, whereby an electrostatic latent image is formed on the photosensitive drum. The electrostatic latent image formed on the photosensitive drum is developed as a toner image by a developing apparatus using toner. The toner image formed on the photosensitive drum is transferred to a recording material, such as recording paper or a plastic sheet, the toner image transferred to the recording material is heated and pressed by a fixing apparatus, and is thereby fixed to the recording material. In this way, an image is formed on the recording material. In addition, the residual toner remaining on the photosensitive drum after the toner image is transferred to the recording material is removed by a cleaning blade.

In this image forming apparatus, the process units, such as the photosensitive drum, the charging roller and the developing apparatus, normally require maintenance. In recent years, the photosensitive drum, the charging roller, the developing apparatus and the cleaning blade are integrated to one cartridge, so as to simplify the maintenance of these process units. A cartridge including these process units is normally called a "process cartridge". The process cartridge is attachable to and detachable from the main body of the image forming apparatus, and the process units can be replaced by changing the process cartridge, whereby maintenance of the process units is performed.

Conventionally an in-line system image forming apparatus, in which a plurality of photosensitive drums are arrayed on an approximately horizontal surface, so as to transfer a toner image on each photosensitive drum to a recording material via an intermediate transfer belt, is known. In another image forming apparatus of this type, a plurality of photosensitive drums, the developing apparatus and the exposing apparatus are disposed below the intermediate transfer belt. If the photosensitive drums, the developing apparatus and the exposing apparatus are disposed below the intermediate transfer belt, the intermediate transfer belt is disposed between the photosensitive drums, the developing apparatus, the exposing apparatus, and the fixing apparatus in the image forming apparatus. Therefore the photosensitive drums, the developing apparatus and the exposing apparatus can be disposed at positions distant from the fixing apparatus. This can suppress the influence of heat from the fixing apparatus on the photosensitive drums, the developing apparatus and the exposing apparatus.

In the case of disposing the photosensitive drums, the developing apparatus and the exposing apparatus below the intermediate transfer belt as described above, the toner storing chamber, which contains toner, is normally disposed below the developing roller which carries the toner used for development. Therefore in the developing apparatus, the toner stored in the toner storing chamber must be transported to the developing roller disposed above the toner storing chamber against gravity.

According to a technique disclosed in Japanese Patent Application Publication No. 2011-039554, a developing apparatus includes a toner storing chamber, a developing roller which carries toner for developing an electrostatic latent image on a photosensitive drum, a developing chamber in which the developing roller is disposed, and a supplying roller which supplies toner in the developing chamber to the developing roller. The toner storing chamber and the developing chamber communicate with each other via an opening. In the case of the technique disclosed in Japanese Patent Application Publication No. 2011-039554, the developing chamber is disposed above the toner storing chamber, hence the toner in the toner storing chamber must be transported to the developing chamber which is located above the toner storing chamber against the gravitational force.

According to the technique disclosed in Japanese Patent Application Publication No. 2011-039554, a sheet type stirring member is disposed in the developing apparatus, and the toner that accumulated at the base of the toner storing chamber is flipped up by rotating the stirring member. Specifically, this sheet type stirring member rotates around the rotation center axis line, stretching approximately in the horizontal direction, whereby the toner that accumulated at the base of the toner storing chamber is elevated. In the state of the stirring member elevating the toner, the stirring member contacts the inner wall surface of the toner storing chamber and bends. Then when the contact state between the inner wall surface of the toner storing chamber and the stirring member is cleared, the stirring member is restored back to its original shape, and by this restoring force, the toner on the stirring member is flipped up into the developing chamber against gravity. In the technique disclosed in Japanese Patent Application Publication No. 2011-039554, the toner inside the toner storing chamber is transported to the developing chamber in this way.

FIG. 11A and FIG. 11B are cross-sectional views of conventional process cartridges. When the capacity of the toner storing chamber is small, as illustrated in FIG. 11A, the distance between the rotation center axis line of the stirring member and the inner wall surface of the toner storing chamber (inner wall surface where the stirring member contacts) is short, therefore the rotation radius of the stirring member is also small. Hence, the length of the sheet type stirring member decreases in a direction orthogonal to the rotation center axis line of the stirring member, and the bending amount of the stirring member decreases when the stirring member is bent by contacting the inner wall surface of the toner storing chamber.

SUMMARY OF THE INVENTION

However, if the capacity of the toner storing chamber is increased to store more toner, the distance between the rotation center axis line of the stirring member and the inner wall surface of the toner storing chamber becomes long, and the rotation radius of the stirring member increases. Therefore the length of the sheet type stirring member increases in a direction orthogonal to the rotation center axis line of the stirring member, and if the materials of the stirring members in FIG. 11A and FIG. 11B are the same, the bending amount of the stirring member increases when the stirring member is bent by contacting the inner wall surface of the toner storing chamber.

When the bending amount of the stirring member increases, the area inclining from the horizontal surface increases in the stirring member, as illustrated in FIG. 11B. This makes the toner laying on the stirring member fall to the base of the toner storing chamber more easily due to its own weight. Hence the amount of toner laying on the stirring member decreases, and the amount of toner to be supplied to the developing chamber becomes insufficient, which may generate blank dots in the image formed on the recording material. Furthermore, in recent years, the process speed of image forming apparatuses have increased, which means that toner consumption amount per unit time is higher, and more toner must be transported to the developing chamber.

In consideration of the above circumstances, it is an object of the present invention to stably supply toner from the toner storing chamber to the developing roller in a developing apparatus, in which the toner inside the toner storing chamber is transported to the developing roller against gravity.

In order to achieve the object described above, a developer container according to an embodiment of the present invention is a developer container, comprising:

a developer containing portion in which developer to be carried by a developer carrying member is stored;

a first sheet member that is disposed in the developer containing portion and transports the developer inside the developer containing portion to the developer carrying member located above the surface position of the developer by rotating around a rotation shaft in a posture taken in use, the first sheet member elastically deforming to bend upon contacting an inner wall surface of the developer containing portion, and then being restored from the bent state upon releasing contact with the inner wall surface; and a second sheet member that is installed on the rotation shaft and rotates in the same phase as the first sheet member, wherein when the rotation shaft rotates in a state in which at least a part of the developer elevated by the first sheet member is positioned above the rotation shaft, the second sheet member rotates on the downstream side of the first sheet member in the rotating direction of the rotation shaft, so as to control the falling of developer on the first sheet member.

A developing apparatus according to an embodiment of the present invention is a developing apparatus, comprising:

the above described developer container; and a developer carrying member that carries developer, wherein an electrostatic latent image formed on an image bearing member is developed by the developer carried on the developer carrying member.

A process cartridge according to an embodiment of the present invention is a process cartridge that is attachable to and detachable from a main body of an image forming apparatus, comprising:

the above described developer container;

a developer carrying member that carries developer; and an image bearing member on which an electrostatic latent image is formed, wherein the electrostatic latent image formed on the image bearing member is developed as a developer image by the developer carried on the developer carrying member.

An image forming apparatus according to an embodiment of the present invention is an image forming apparatus, comprising:

the above described developer container;

a developer carrying member that carries developer; and an image bearing member on which an electrostatic latent image is formed, wherein the electrostatic latent image formed on the image bearing member is developed as a developer image by the developer carried on the developer carrying member, and an image is formed on a recording medium from the developer image formed on the image bearing member.

According to the present invention, toner can be stably supplied from the toner storing chamber to the developing roller in a developing apparatus, in which the toner inside the toner storing chamber is transported to the developing roller against gravity.

Further features of the present invention will become apparent from the following description of exemplary embodiments with reference to the attached drawings.

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Electro-photographic Image Forming Apparatus 100

Figure 2:
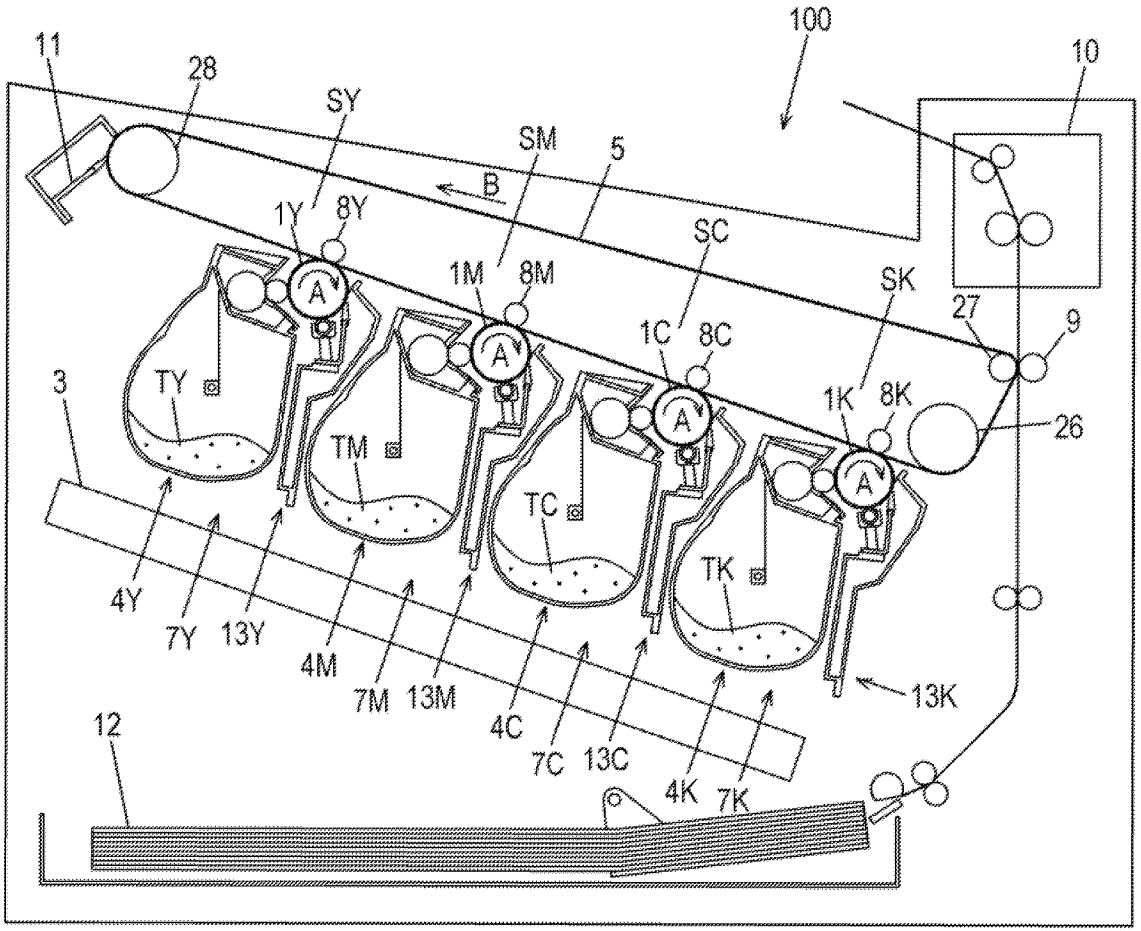
FIG. 2 is a schematic cross-sectional view of an image forming apparatus according to Example 1.
Figure 3:
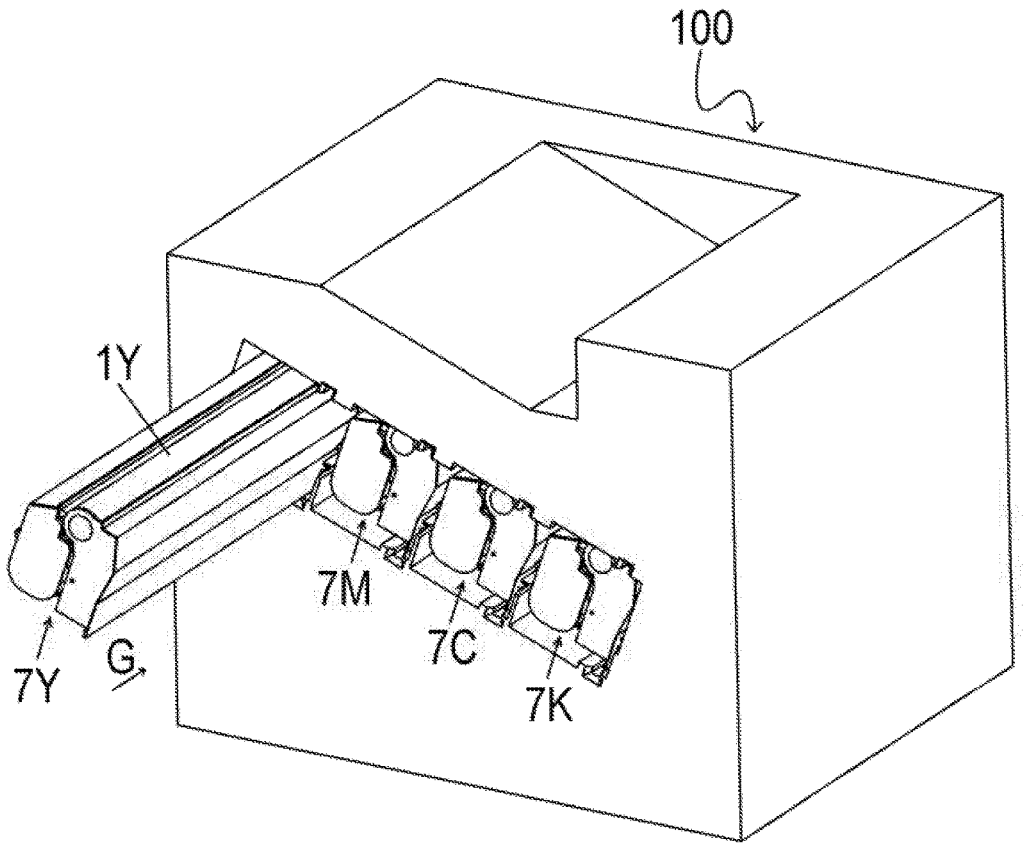
FIG. 3 is a diagram depicting the state of installing the process cartridge according to Example 1 in the apparatus main body.

A general configuration of an electro-photographic image forming apparatus 100 (image forming apparatus 100) according to Example 1 will be described with reference to FIG. 2 and FIG. 3. FIG. 2 is a schematic diagram of the image forming apparatus 100 according to Example 1. FIG. 3 is a perspective view depicting a state of installing a process cartridge 7 in the image forming apparatus 100. The image forming apparatus 100 has a plurality of image forming portions SY to SK, which are first to fourth image forming portions for forming yellow (Y), magenta (M), cyan (C) and black (K) images respectively.

In Example 1, the first to fourth image forming portions have substantially the same configuration and perform the same operation, except that the color of the image to be formed is different. Therefore in the following description, the suffixes Y to K are omitted unless distinction is necessary. In Example 1, the image forming apparatus 100 includes four photosensitive drums 1 (1Y to 1K) which are image bearing members. Each photosensitive drum 1 rotates in the arrow A direction in FIG. 2. A charging roller 2 (2Y to 2K) and a scanner unit 3 are disposed around the photosensitive drum 1.

The charging roller 2 is a charging unit that uniformly charges the surface of the photosensitive drum 1. The scanner unit 3 is an exposing unit that forms an electrostatic latent image on the photosensitive drum 1 by irradiating a laser based according to the image information. A developing unit 4 (4Y to 4K) (corresponding to the developing apparatus) and a cleaning blade, which is a cleaning unit, are disposed around the photosensitive drum 1. Here the developing unit 4 at least includes a developing roller 17, which is a developer carrying member that carries developer.

Further, facing the four photosensitive drums 1, an intermediate transfer belt 5 for transferring a toner image, which is a developer image on the photosensitive drum 1, to a recording material 12 (corresponding to the recording medium) is disposed. In Example 1, toner T (TY to TK), which is a non-magnetic one-component developer, is used for the developing unit 4. In Example 1, the developing unit 4 performs contact development by contacting the developing roller 17 to the photosensitive drum 1.

A photosensitive unit 13 has a removed toner storing portion (see FIG. 1) which stores un-transferred residual toner (waste toner) remaining on the photosensitive drum 1, the photosensitive drum 1, the charging roller 2, and the cleaning blade. Further, in Example 1, the process cartridge 7 (7Y to 7K) is configured by integrating the developing unit 4 and the photosensitive unit 13 into a cartridge. The process cartridge 7 is attachable to and detachable from the image forming apparatus 100 via an installing unit, such as an installing guide and a positioning member (not illustrated), disposed in the image forming apparatus 100.

Further, the process cartridge 7 at least includes a photosensitive drum 1 which carries a developer image.

In Example 1, the process cartridge 7 can be installed into the main body of the image forming apparatus 100 in the arrow G direction in FIG. 3, which is the axis direction of the photosensitive drum 1. In Example 1, the shape of a process cartridge 7 for each color is identical. However, the present invention is not limited to this, and the shape and size of a process cartridge 7 may be different. For example, the size of the cartridge for black may be larger than other cartridges in order to increase capacity. In the process cartridge 7 for each color, toner T (TY to TK) of each color, yellow (TY), magenta (TM), cyan (TC) and black (TK), is stored respectively. The intermediate transfer belt 5 contacts all the photosensitive drums 1, and moves in the arrow B direction in FIG. 2. The intermediate transfer belt 5 is wound around a plurality of supporting members (driving roller 26, secondary transfer counter roller 27, and driven roller 28).

Four primary transfer rollers 8 (8Y to 8K) are disposed in parallel on the inner surface side of the intermediate transfer belt 5, so as to face each photosensitive drum 1. Further, a secondary transfer roller 9 is disposed on the outer surface side of the intermediate transfer belt 5 at a position facing the secondary transfer counter roller 27.

Image Forming Process

When an image is formed, first the surface of each photosensitive drum 1 is uniformly charged by the charging roller 2. Then the surface of the photosensitive drum 1 is scanned and exposed by laser light irradiated from the scanner unit 3, so as to form an electrostatic latent image on the photosensitive drum 1 based on the image information. The electrostatic latent image formed on the photosensitive drum 1 is developed as a toner image by the developing unit 4. The toner image formed on the photosensitive drum 1 is primarily transferred onto the intermediate transfer belt 5 by the primary transfer roller 8.

For example, when a full color image is formed, the above mentioned process is sequentially performed by the image forming portions SY to SK, which are the first to fourth image forming portions, whereby the toner image in each color is sequentially superimposed on the intermediate transfer belt 5. Then synchronizing with the movement of the intermediate transfer belt 5, a recording material 12 is transported to the secondary transfer portion. The four color toner image on the intermediate transfer belt 5 is secondarily transferred collectively to the recording material 12 by the secondary transfer roller 9, which is in contact with the intermediate transfer belt 5 via the recording material 12.

Then the recording material 12, on which the toner image is transferred, is transported to a fixing apparatus 10. The recording material 12 is heated and pressed in the fixing apparatus 10, whereby the toner image is fixed to the recording material 12. The primary un-transferred residual toner remaining on the photosensitive drum 1 after the primary transfer step is removed by the cleaning blade. The secondary un-transferred residual toner remaining on the intermediate transfer belt 5, after the secondary transfer step, is removed by an intermediate transfer belt cleaning apparatus 11. The removed un-transferred residual toner (waste toner) is discharged to a waste toner box (not illustrated) of the image forming apparatus 100. The image forming apparatus 100 can also form a monochrome image or a multicolor image using only a desired one or more (but not all) image forming portion(s).

Process Cartridge

Figure 1:
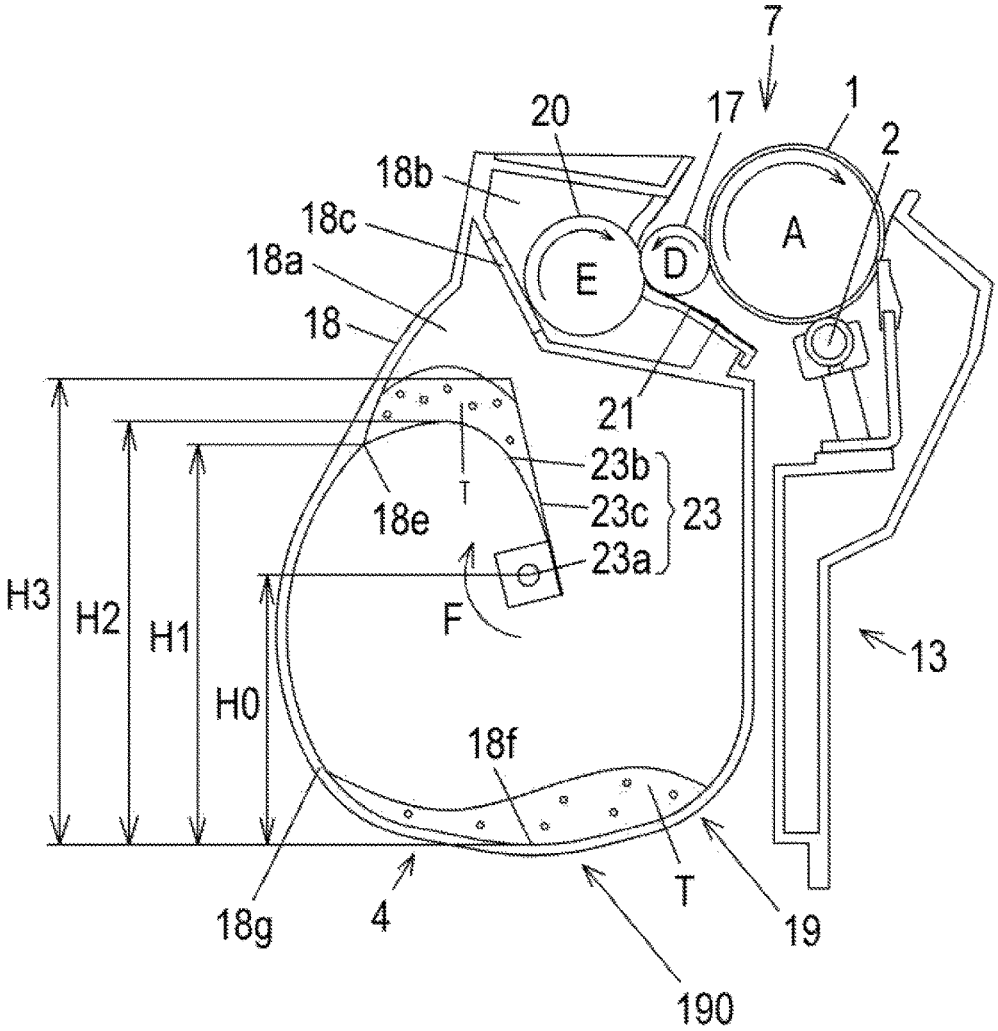
FIG. 1 is a schematic cross-sectional view of a process cartridge according to Example 1.

A general configuration of the process cartridge 7, which is installed to the image forming apparatus 100 according to Example 1, will be described next with reference to FIG. 1. FIG. 1 is a schematic diagram of the process cartridge 7 according to Example 1. The developing unit 4 has a developing frame body 18 which supports various members in the developing unit 4. Here a portion of the developing frame body 18, which stores toner, is called the "container main body 19" (corresponding to the developer storing portion). A developing roller 17, which transports toner to the photosensitive drum 1 by contacting the photosensitive drum 1, is disposed in the developing unit 4. The developing roller 17 carries toner and rotates in the arrow D direction (counterclockwise direction) in FIG. 1. Both ends of the developing roller 17 in the longitudinal direction (rotation center axis direction) are rotatably supported by the bearings in the developing frame body 18. In Example 1, the container main body 19, a stirring sheet 23*b*, and a stirring assist member 23*c* constitute a developer container 190.

The developing unit 4 includes: a toner storing chamber 18*a* (corresponding to inside the developer storing unit), which is a space inside the container main body 19; a developing chamber 18*b* in which the developing roller 17 is disposed; and an opening 18*c* through which the toner storing chamber 18*a* and the developing chamber 18*b* communicate with each other. In Example 1, in a normal use posture of the developing unit 4, the developing chamber 18*b* is located above the toner storing chamber 18*a*.

A toner supply roller 20 which contacts the developing roller 17 and rotates in the arrow E direction, and a developing blade 21 which regulates the thickness of the toner layer to be formed on the developing roller 17, are disposed in the developing chamber 18*b*.

In the toner storing chamber 18*a* inside the container main body 19, a stirring member 23, which stirs the stored toner T and transports the toner to the toner supply roller 20 through an opening 18*c*, is disposed. Specifically, the stirring member 23 transports the toner T inside the toner storing chamber 18*a* toward the developing roller 17, which is disposed above the surface position of the toner.

The stirring member 23 includes: a rotation shaft 23*a* which is parallel with the rotation shaft direction of the developing roller 17; and a stirring sheet 23*b* (corresponding to the first sheet member) which is a flexible sheet. One end of the stirring sheet 23*b* is installed on (fixed to) the rotation shaft 23*a*, and the other end of the stirring sheet 23*b* is a free end, and toner is stirred by the stirring sheet 23*b*, as the stirring sheet 23*b* is rotated by rotation of the rotation shaft 23*a*. The stirring member 23 rotates so as to slide on a region which includes at least the base portion 18*f* of the inner wall surface of the container main body 19. The end of the stirring sheet 23*b* and the end of the stirring assist member 23*c* (see FIG. 1) are installed at the same position on the rotation shaft 23*a*. Therefore the end of the stirring sheet 23*b* and the end of the stirring assist member 23*c* are rotated in the same phases while the rotation shaft 23*a* is rotating. In Example 1, the rotation shaft 23*a* extends in an approximately horizontal direction in a normal use posture (posture taken in use) of the developing unit 4.

When the stirring member 23 stirs the toner, the stirring sheet 23*b* contacts the inner wall surface of the container main body 19, and the stirring member 23 rotates in a state in which the stirring sheet 23*b* is bent (deforms elastically). Here the inner wall surface of the container main body 19 includes a release position 18*e*, which is a position where the stirring sheet 23*b* is released from the bent state. The stirring sheet 23*b* is released from the bent state by passing through the release position 18*e*, and toner laying on the stirring sheet is flipped up by the restoring force, which is generated by release from the bent state. The toner thus flipped up is transported to a toner supply roller 20 inside the developing chamber 18*b* through the opening 18*c*. The photosensitive unit 13 has a cleaning frame body that supports the components constituting the photosensitive unit 13. The photosensitive drum 1 is rotatably disposed in the cleaning frame body in the arrow A direction in FIG. 1.

The cleaning blade is constituted by: an elastic member that removes the un-transferred residual toner (waste toner) remaining on the surface of the photosensitive drum 1 after the primary transfer; and a support member that supports the elastic member. The waste toner removed from the surface of the photosensitive drum 1 by the cleaning blade is stored in the removed toner storing portion, which is constituted by a cleaning blade and a cleaning frame body.

Configuration to Transport Toner to Developing Chamber 18*b*

Figure 4:
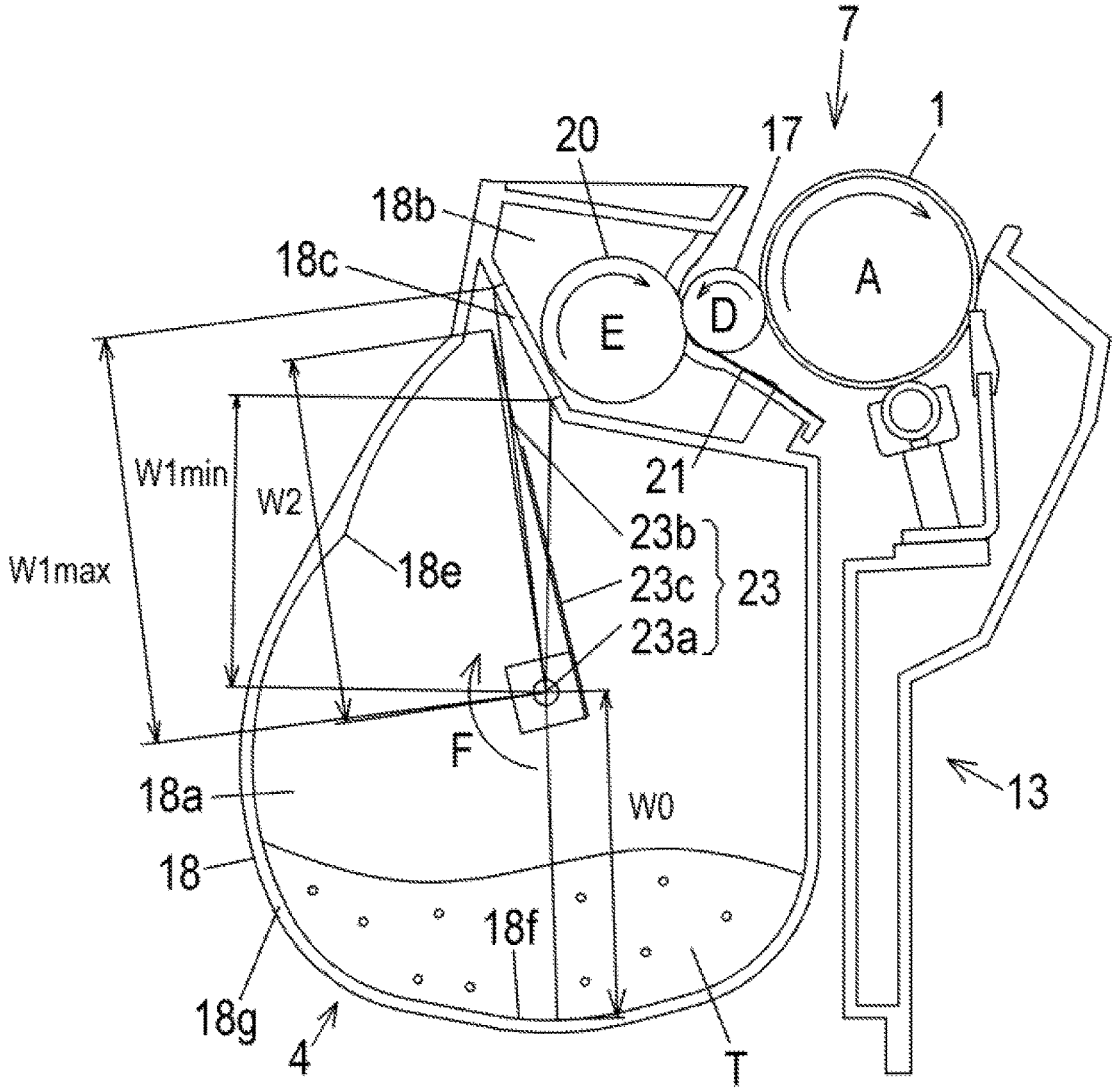
FIG. 4 is a schematic cross-sectional view of the process cartridge according to Example 1.

The configuration to transport the toner inside the toner storing chamber 18*a* to the developing chamber 18*b* will be described next with reference to FIG. 4 and FIG. 5. FIG. 4 is a schematic cross-sectional view of the process cartridge 7 according to Example 1. FIG. 5 is a diagram depicting a state of transporting the toner inside the toner storing chamber in Example 1

In Example 1, the stirring sheet 23*b* rotates inside the toner storing chamber 18*a* in the bent state caused by contacting the inner wall surface of the toner storing chamber 18*a*. A release position 18*e*, to restore the stirring sheet 23*b* from the bent state to the original state (unbent state), is provided in the toner storing chamber 18*a*. In Example 1, the portion at the release position 18*e* on the inner wall surface inside the toner storing chamber 18*a* has a concave shape protruding from the portion around the release position 18*e*.

In the inner wall surface of the toner storing chamber 18*a*, the portion on the upstream side of the release position 18*e*, in the rotating direction of the stirring member 23, is defined as a transport regulating surface 18*g*. The stirring sheet 23*b* flips up the toner laying on the stirring sheet 23*b* (corresponding to the first sheet member) by the restoring force, which is generated when the stirring sheet 23*b* returns from the bent state to the original state, at a timing of passing through the release position 18*e*. Thereby the toner on the stirring sheet 23*b* is transported to the toner supply roller 20 inside the developing chamber 18*b* through the opening 18*c*.

In Example 1, the toner that is loaded at the base portion 18*f* of the toner storing chamber 18*a* is stirred and transported by the stirring sheet 23*b*. For this, in Example 1, the rotation radius W2 of the stirring sheet 23*b* is longer than the length W0 from the rotation center axis line of the rotation shaft 23*a* to the base portion 18*f* of the toner storing chamber 18*a*, as illustrated in FIG. 4. Here the rotation radius W2 of the stirring sheet 23*b* is the length from the rotation center axis line of the rotation shaft 23*a* to the tip end of the stirring sheet 23*b*.

In Example 1, the tip end of the stirring sheet 23*b* contacts the edge portion (inner edge) of the opening 18*c*, whereby the toner on the stirring sheet 23*b* is pushed into the developing chamber 18*b* through the opening 18*c*. For this, as illustrated in FIG. 4, the rotation radius W2 of the stirring sheet 23*b* is smaller than the maximum distance W1max (maximum value of the distance) from the rotation center axis line of the rotation shaft 23*a* to the edge of the opening 18*c*, and is greater than the minimum distance W1min (minimum value of the distance). In other words, in Example 1, the maximum distance W1max>rotation radius W2>minimum distance W1min. Specifically, the maximum distance W1max is a distance from the rotation center axis line of the rotation shaft 23*a* to the edge of the opening 18*c* most distant from the rotation shaft 23*a*, in the cross-sectional view sectioned in a direction orthogonal to the rotation center axis line of the rotation shaft 23*a*. The minimum distance W1min is a distance from the rotation center axis line of the rotation shaft 23*a* to the edge of the opening 18*c* closest to the rotation shaft 23*a*, in the cross-sectional view sectioned in the direction orthogonal to the rotation center axis line of the rotation shaft 23*a*.

In Example 1, a stirring assist member 23*c* (corresponding to the second sheet member), which is a flexible sheet member, is disposed in the stirring member 23 in order to suppress toner laying on the stirring sheet 23*b* from falling off the stirring sheet 23*b*. As illustrated in FIG. 1, the stirring assist member 23*c* is installed at the same position as the stirring sheet 23*b* on the rotation shaft 23*a*. In the state in which toner is laying on the stirring sheet 23*b*, the stirring sheet 23*b* rotates on the upstream side of the stirring assist member 23*c* in the rotating direction of the rotation shaft 23*a*, as illustrated in FIG. 1. Specifically, in Example 1, the stirring assist member 23*c* rotates on the downstream side of the stirring sheet 23*b* in the rotating direction of the stirring sheet 23*b* in a state in which at least a part of the toner elevated by the stirring sheet 23*b* is located above the rotation shaft 23*a*. Thereby in Example 1, the falling off of the toner laying on the stirring sheet 23*b* can be suppressed.

In Example 1, as illustrated in FIG. 1, the height H3 of the tip end of the stirring assist member 23*c* is higher than the maximum height H2 of the stirring sheet 23*b* at a timing when the tip end of the stirring sheet 23*b* is located at the release position 18*e* (H3>H2). Specifically, the height H3 is the height from the base portion 18*f* of the toner storing chamber 18*a* to the tip end of the stirring assist member 23*c* at a timing when the tip end of the stirring sheet 23*b* is located at the release position 18*e*. The maximum height H2 is the distance from the base portion 18*f* of the toner storing chamber 18*a* to the highest position of the stirring sheet 23*b* at a timing when the tip end of the stirring sheet 23*b* is located at the release position 18*e*. In other words, in Example 1, when the stirring sheet 23*b* is restored from the bent state, the tip end of the stirring sheet 23*b* is located above the rotation shaft 23*a* in a normal use posture of the developing unit 4. Further, when the stirring sheet 23*b* is restored from the bent state, the tip end of the stirring assist member 23*c* is located above any position of the stirring sheet 23*b* in a normal use posture of the developing unit 4. Furthermore, in Example 1, the relationship between the height H0 from the base portion 18*f* of the toner storing chamber 18*a* to the rotation shaft 23*a* and the height H1 from the base portion 18*f* to the release position 18*e* is height H1>height H0. In Example 1, the relationship between the height H3, the height H2, the height H1 and the height H0 is height H3>height H2>height H1>height H0.

Figure 5A:
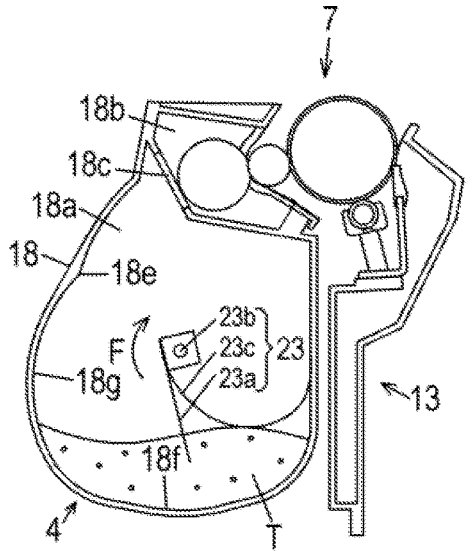
FIG. 5A to FIG. 5D are diagrams depicting the state of transporting toner inside the toner storing chamber to the developing chamber.
Figure 5B:
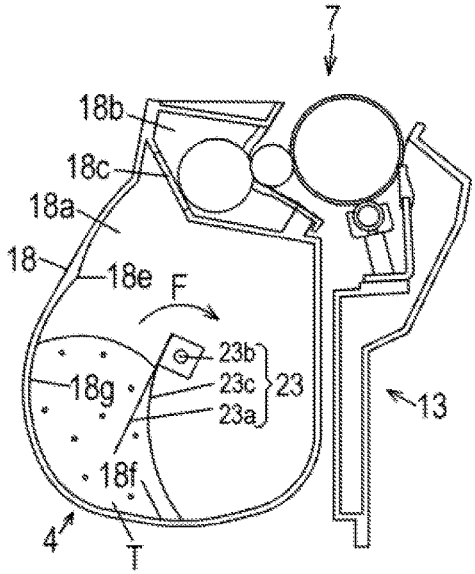

The changes in the state of the stirring sheet 23*b*, the stirring assist member 23*c* and the toner while the stirring member 23 rotates through one revolution will be described next with reference to FIG. 5A to FIG. 5D. In FIG. 5A, the rotating stirring sheet 23*b* starts to push toner that is loaded in the toner storing chamber 18*a*. Then in FIG. 5B, the stirring sheet 23*b* further rotates in the arrow F direction, so that the stirring sheet 23*b* elevates the toner inside the toner storing chamber 18*a*. Then the stirring sheet 23*b* rotates in the arrow F direction, while maintaining the state of contacting with the transport regulating surface 18*g*.

Figure 5C:
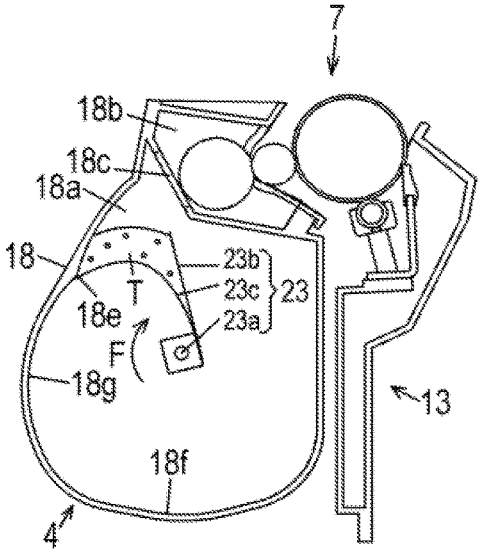

In FIG. 5C, the tip end of the rotating stirring sheet 23*b* reaches the release position 18*e*. Here toner is on the stirring sheet 23*b*, and at a timing when the tip end of the stirring sheet 23*b* passes through the release position 18*e*, the stirring sheet 23*b* in the bent state returns to the original state. Then by the restoring force generated when the stirring sheet 23*b* is restored, the toner on the stirring sheet 23*b* is flipped up toward the opening 18*c* and the developing roller 17.

In Example 1, the stirring assist member 23*c* is installed on the rotation shaft 23*a*, as illustrated in FIG. 5C, therefore this can suppress toner on the stirring sheet 23*b* from falling off the stirring sheet 23*b*. In particular, when the tip end of the stirring sheet 23*b* is located at the release position 18*e*, as illustrated in FIG. 5C, bending of the stirring sheet 23*b* is considerable, hence toner tends to fall off the stirring sheet 23*b* along the slope of the stirring sheet 23*b*. However, in Example 1, the stirring assist member 23*c* is installed on the rotation shaft 23*a*. Since this stirring assist member 23*c* supports the toner on the stirring sheet 23*b*, a decrease in the toner amount (corresponding to the developer amount) on the stirring sheet 23*b* can be suppressed. Further, in Example 1, the height H3 of the tip end of the stirring assist member 23*c* is higher than the maximum height H2 of the stirring sheet 23*b* at the timing when the tip end of the stirring sheet 23*b* is located at the release position 18*e*, as mentioned above (see FIG. 4). Therefore the fall of toner on the stirring sheet 23*b* over the stirring assist member 23*c* can be suppressed.

Figure 5D:
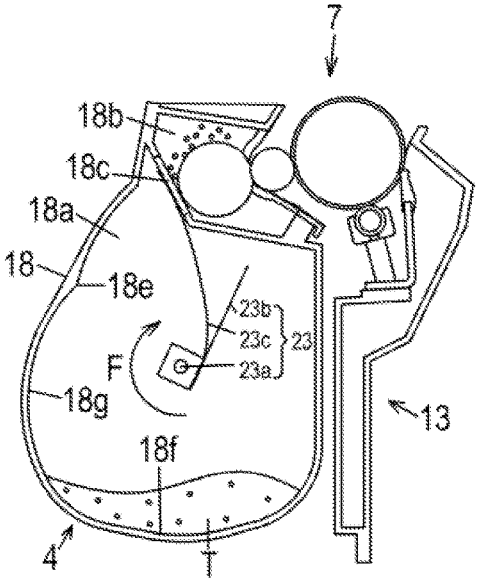

Then in FIG. 5D, the toner on the stirring sheet 23*b* is transported toward the opening 18*c* by the restoring force to restore the stirring sheet 23*b* in the bent state to the original state. Then the restored stirring sheet 23*b* collides with the edge of the opening 18*c*, whereby the toner T on the stirring sheet 23*b* is pushed into the developing chamber 18*b*. The stirring sheet 23*b* then further rotates in the arrow F direction, and the state inside the toner storing chamber 18*a* returns to the state illustrated in FIG. 5A. By the stirring sheet 23*b* continuously rotating in the arrow F direction in this manner, the toner on the stirring sheet 23*b* is transported into the developing chamber 18*b* through the opening 18*c*, each time the tip end of the stirring sheet 23*b* passes through the release position 18*e*.

In Example 1, the stirring sheet 23*b* and the stirring assist member 23*c* are made of a flexible material, such as polyethylene terephthalate (PET) and polycarbonate (PC). The stirring sheet 23*b* and the stirring assist member 23*c* each preferably have a thickness of 400 μm or less, since the toner is transported using an elastic force when the stirring sheet 23*b* and the stirring assist member 23*c* are bent.

Figure 6:
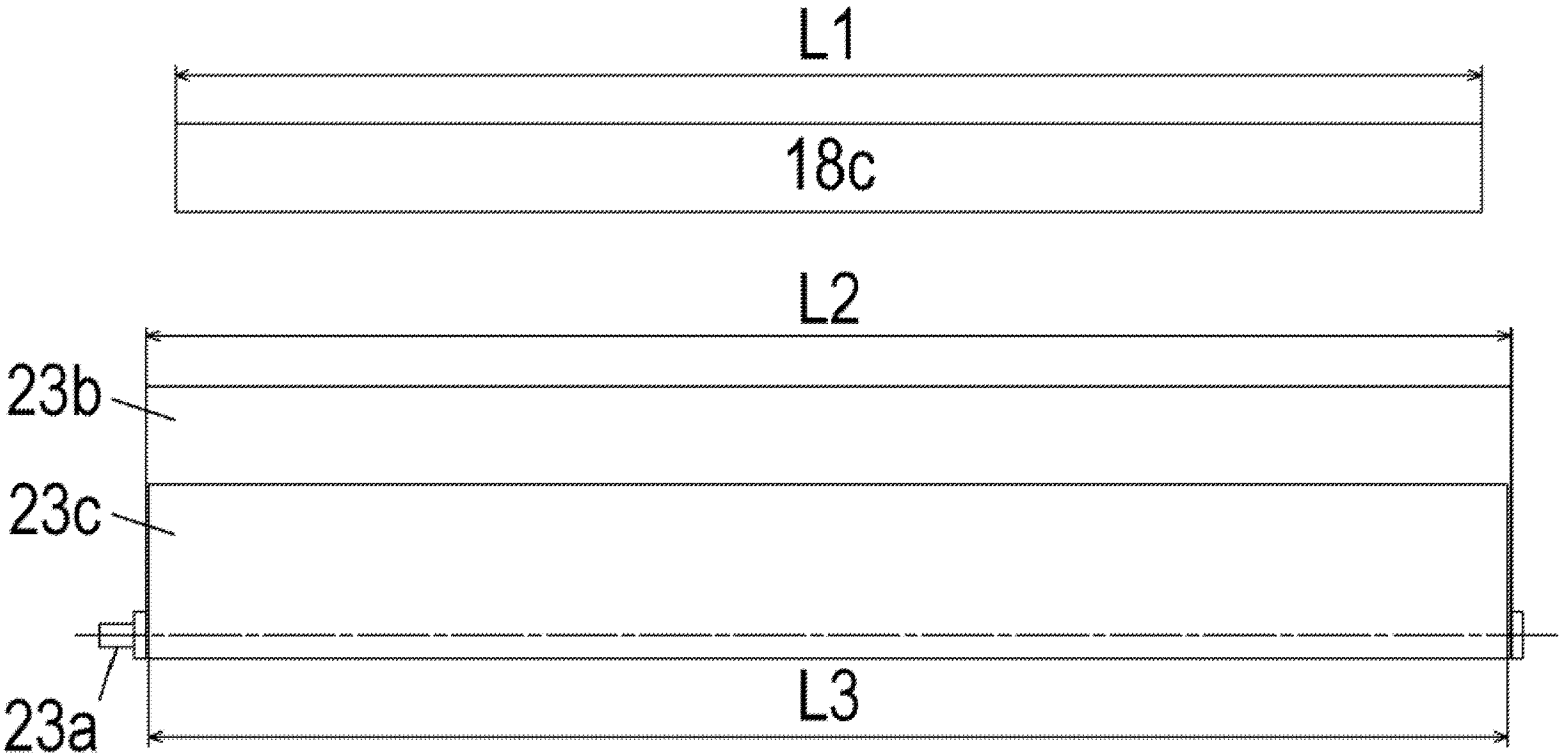
FIG. 6 is a diagram comparing the width of the opening, the width of the stirring sheet, and the width of the stirring assist member.

FIG. 6 is a diagram for comparing the width L1 of the opening 18*c*, the width L2 of the stirring sheet 23*b*, and the width L3 of the stirring assist member 23*c*. In Example 1, the relationship between the width L1 of the opening 18*c*, the width L2 of the stirring sheet 23*b*, and the width L3 of the stirring assist member 23*c* is L2>L1 and L3>L1, as illustrated in FIG. 6, so that the toner can be transported into the developing chamber 18*b* through the entire area of the opening 18*c* in the longitudinal direction. Specifically, the width L1 is the length of the opening 18*c* in the longitudinal direction, the width L2 is the length of the stirring sheet 23*b* in the longitudinal direction (extending direction of the rotation shaft 23*a*), and the width L3 is the length of the stirring assist member 23*c* in the longitudinal direction. In Example 1, the longitudinal direction of the opening 18*c*, the longitudinal direction of the stirring sheet 23*b*, and the longitudinal direction of the stirring assist member 23*c* are approximately parallel with the rotation center axis line of the rotation shaft 23*a*.

The stirring assist member 23*c* is disposed on the downstream side of the stirring sheet 23*b* in the rotating direction of the rotation shaft 23*a*, hence if the stirring assist member 23*c* contacts the inner wall surface of the toner storing chamber 18*a*, the stirring assist member 23*c* elevates the toner. In this case, the amount of the toner laying on the stirring sheet 23*b* decreases. Therefore in Example 1, the length of the stirring assist member 23*c* is a length with which the stirring assist member 23*c* does not contact the inner wall surface of the toner storing chamber 18*a*.

As described above, according to Example 1, the stirring assist member 23*c* rotates in the same phase as the stirring sheet 23*b*. The stirring assist member 23*c* rotates on the downstream side of the stirring sheet 23*b* in the rotating direction of the stirring sheet 23*b*, in the state in which at least a part of the toner elevated by the stirring sheet 23*b* is positioned above the rotation shaft 23*a*. Thereby the stirring assist member 23*c* suppresses the toner from falling off the stirring sheet 23*b*, and the toner can be stably supplied from the toner storing chamber 18*a* to the developing chamber 18*b*.

Example 2

Figure 8:
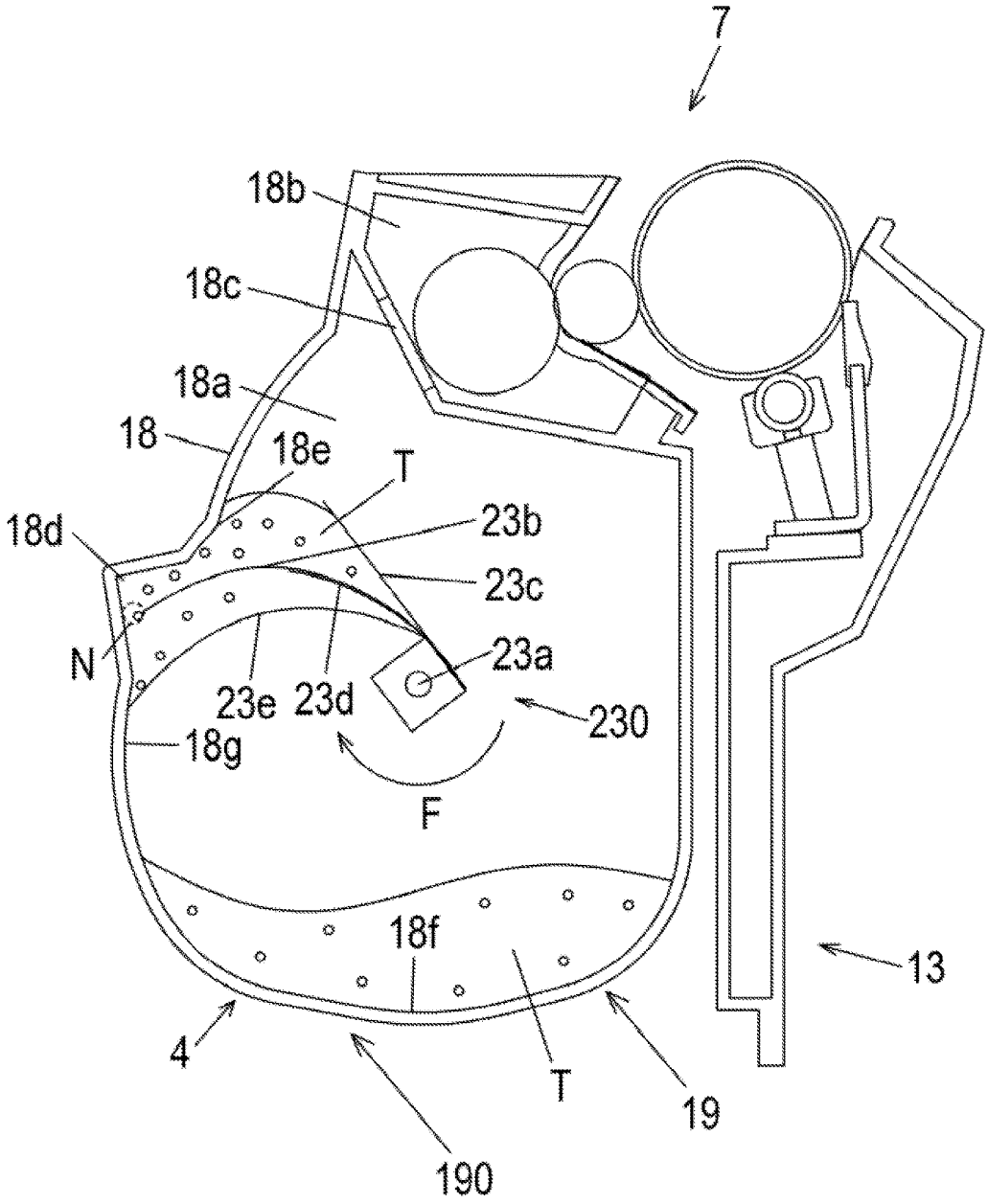
FIG. 8 is a schematic cross-sectional view of a process cartridge according to Example 2.

Example 2 will be described next. In Example 2, the basic configurations of the image forming apparatus and the process cartridge are the same as Example 1. Therefore in Example 2, a composing element having the same function as Example 1 is denoted with the same reference sign, and description thereof is omitted. FIG. 8 is a schematic cross-sectional view of the process cartridge according to Example 2. In Example 2, as illustrated in FIG. 8, a concave portion 18*d* is disposed in the toner storing chamber 18*a*, as a means of detecting the residual toner amount in the toner storing chamber 18*a*. The concave portion 18*d* is disposed on the upstream side of the release position 18*e* in the rotating direction of the stirring member 230. The concave portion 18*d* is also disposed in such a position that the toner on the stirring sheet 23*b* enters the concave portion 18*d* in the process of the stirring sheet 23*b* rotating with elevating the toner.

When the residual toner amount inside the toner storing chamber 18*a* becomes less than a predetermined amount, the toner amount transported into the concave portion 18 *d* (corresponding to inside the concave portion) decreases as the residual toner inside the toner storing chamber 18*a* decreases. Therefore the residual toner amount inside the toner storing chamber 18*a* can be obtained by measuring the toner amount that is transported into the concave portion 18*d*. In the concave portion 18*d*, a pair of (a plurality of) electrodes, not illustrated, are disposed, for example, and the toner amount transported to the concave portion 18*d* can be measured by determining the electrostatic capacitance between the pair of electrodes. Further, it is assumed that information on the relationship between the toner amount transported to the concave portion 18*d* and the residual toner amount inside the toner storing chamber 18*a* is stored in a recording medium (e.g. HDD), which is not illustrated, disposed in the image forming apparatus 100, for example. Based on this information on the relationship stored in the storage medium, the residual toner amount inside the toner storing chamber 18*a* is obtained from the toner amount transported to the concave portion 18*d*.

Figure 7:
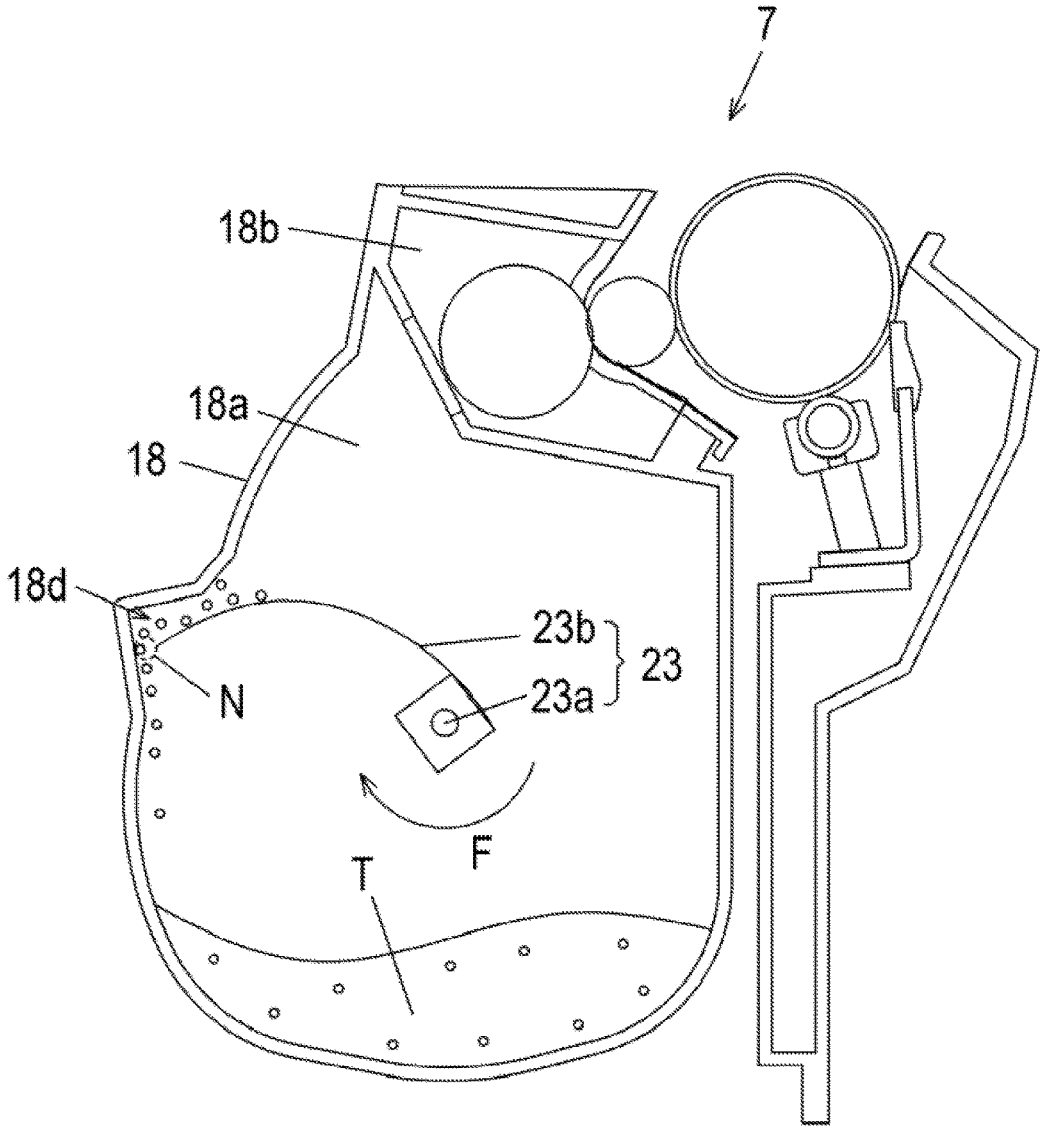
FIG. 7 is a schematic cross-sectional view of the process cartridge in which the stirring receive member is not disposed.

FIG. 7 is a schematic cross-sectional view of the process cartridge, where a stirring receive member 23*e* (third sheet member) is not disposed in the stirring member 23. In the case where the concave portion 18*d* is disposed inside the toner storing chamber 18*a*, as illustrated in FIG. 7, the tip end of the stirring sheet 23*b* does not contact the wall surface forming the concave portion 18*d* (corresponding to the inner wall surface of the concave portion) when the stirring sheet 23*b* passes through the concave portion 18*d*. In other words, there is a gap N between the inner wall surface of the concave portion 18*d* and the stirring sheet 23*b* when the stirring sheet 23*b* rotates while elevating the toner. Therefore in the case of the configuration illustrated in FIG. 7, the toner on the stirring sheet 23*b* falls off through the gap N between the tip end of the stirring sheet 23*b* and the wall surface of the concave portion 18*d*. As a result, the toner amount laying on the stirring sheet 23*b* decreases.

Therefore in Example 2, as illustrated in FIG. 8, a flexible sheet type stirring receive member 23*e* is installed on the rotation shaft 23*a* on the upstream side of the stirring sheet 23*b* in the rotating direction of the rotation shaft 23*a* so as to overlap with the stirring sheet 23*b*. Therefore the end of the stirring receive member 23*e* rotates in the same phase as the ends of the stirring sheet 23*b* and the stirring assist member 23*c* while the rotation shaft 23*a* is rotating. Then when the stirring sheet 23*b* passes through the concave portion 18*d*, the stirring receive member 23*e* contacts a transport regulating surface 18*g* (inner wall surface of toner storing chamber 18*a*) disposed on the upstream side of the concave portion 18*d* in the rotating direction of the rotation shaft 23*a*. Specifically, in Example 2, the stirring receive member 23*e* rotates while contacting with the inner wall surface of the toner storing chamber 18*a* on the upstream side of the stirring sheet 23*b* in the rotating direction of the stirring sheet 23*b*. Thereby in Example 2, it can be suppressed that the toner falls off the stirring sheet 23*b* through the gap N and drops in the base portion 18*f*. In Example 2, the developer container 190 is configured to include the container main body 19, the stirring sheet 23*b*, the stirring assist member 23*c*, and the stirring receive member 23*e*.

As mentioned above, according to Example 2, the stirring receive member 23*e* must be rotated on the upstream side of the stirring sheet 23*b*, in the rotating direction of the rotation shaft 23*a* when the stirring sheet 23*b* rotates while elevating the toner. Therefore in Example 2, the stirring support member 23*d* is installed on the rotation shaft 23*a*, so as to locate between the stirring sheet 23*b* and the stirring receive member 23*e*.

Figure 9:
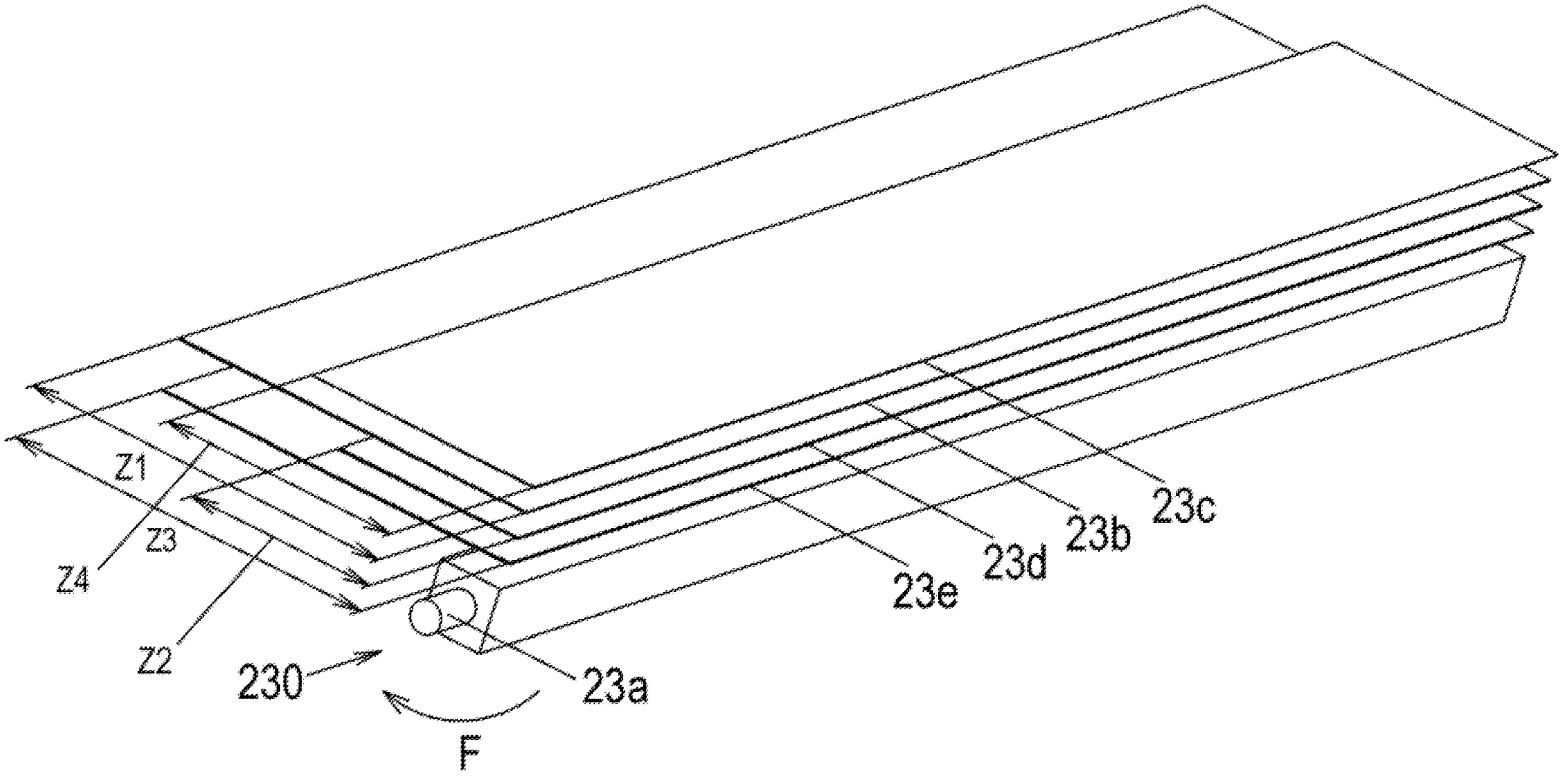
FIG. 9 is an exploded perspective view of a stirring member according to Example 2.

FIG. 9 is an exploded perspective view of the stirring member 230 according to Example 2. According to Example 2, in the direction orthogonal to the rotation center axis line of the rotation shaft 23*a*, the relationship between the length Z1 of the stirring sheet 23*b*, the length Z2 of the stirring support member 23*d*, and the length Z3 of the stirring receive member 23*e* is $Z2<Z1$ and $Z2<Z3$, as illustrated in FIG. 9. By installing the stirring support member 23*d* on the rotation shaft 23*a*, the bending amount of the stirring sheet 23*b* and the bending amount of the stirring receive member 23*e* become different, as illustrated in FIG. 8. Thereby when the stirring sheet 23*b* rotates while elevating the toner, the stirring receive member 23*e* rotates on the upstream side of the stirring sheet 23*b* in the rotating direction of the rotation shaft 23*a*. In Example 2 as in Example 1, the stirring assist member 23*c* is disposed on the rotation shaft 23*a*, on the downstream side of the stirring sheet 23*b* in the rotating direction of the rotation shaft 23*a* so as to overlap with the stirring sheet 23*b*.

Figure 10A:
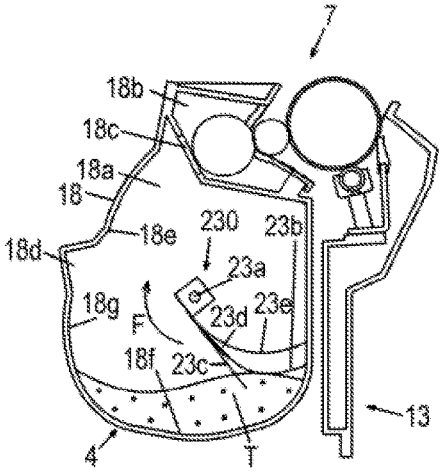
FIG. 10A to FIG. 10E are diagrams depicting the state of transporting toner inside the toner storing chamber to the developing chamber.
Figure 10B:
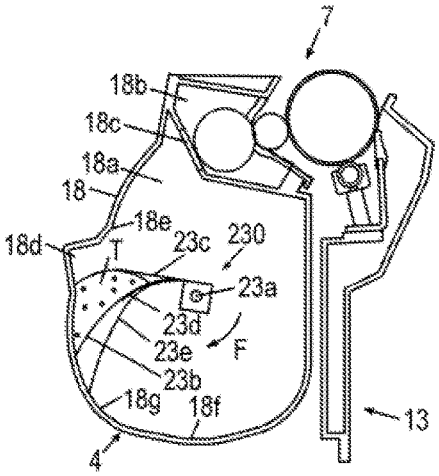

The changes in the state of the stirring member 230 and the toner, while the stirring member 230 rotates through one revolution, will be described next with reference to FIG. 10A to FIG. 10E. FIG. 10A to FIG. 10E are diagrams depicting the state in which the toner inside the toner storing chamber 18*a* is transported to the developing chamber 18*b*. First, as illustrated in FIG. 10A, the stirring member 230 rotates so that the stirring sheet 23*b* starts to push the toner. After the tip end of the stirring sheet 23*b* passes through the base portion 18*f* of the toner storing chamber 18*a*, the stirring sheet 23*b* rotates while contacting the transport regulating surface 18*g*, as illustrated in FIG. 10B, whereby the toner inside the toner storing chamber 18*a* is elevated.

Figure 10C:
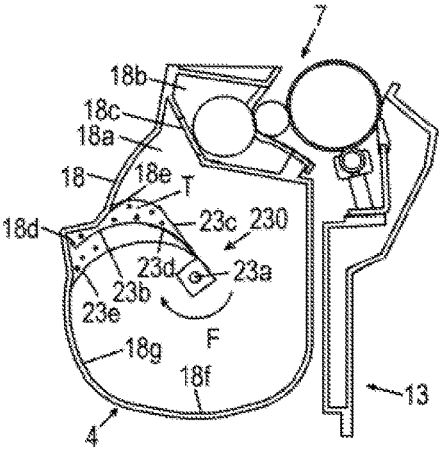
Figure 10D:
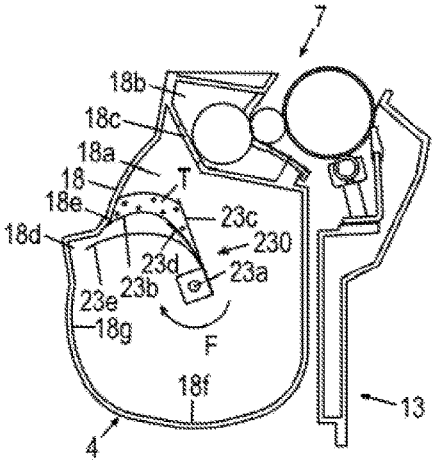
Figure 10E:
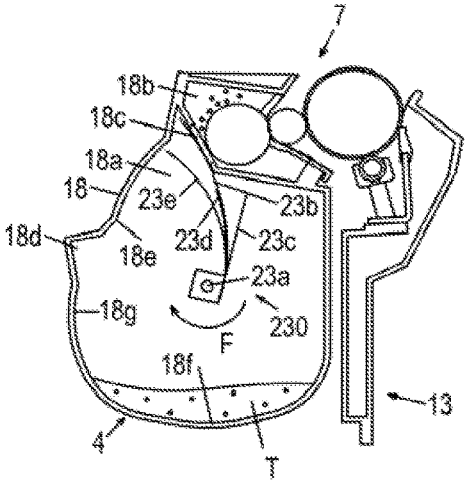
Figure 11B:
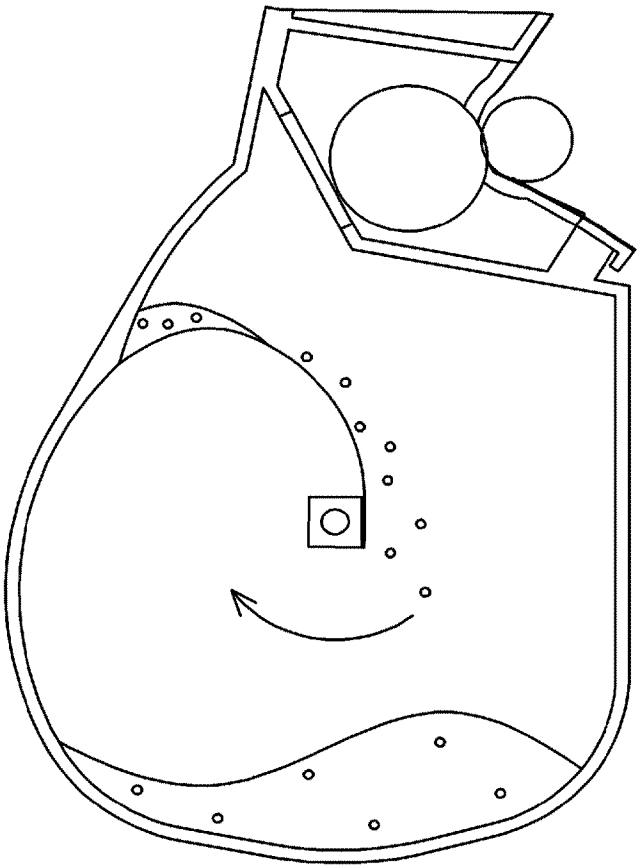
FIG. 11A and FIG. 11B are schematic cross-sectional views of a conventional process cartridge.
Figure 11A:
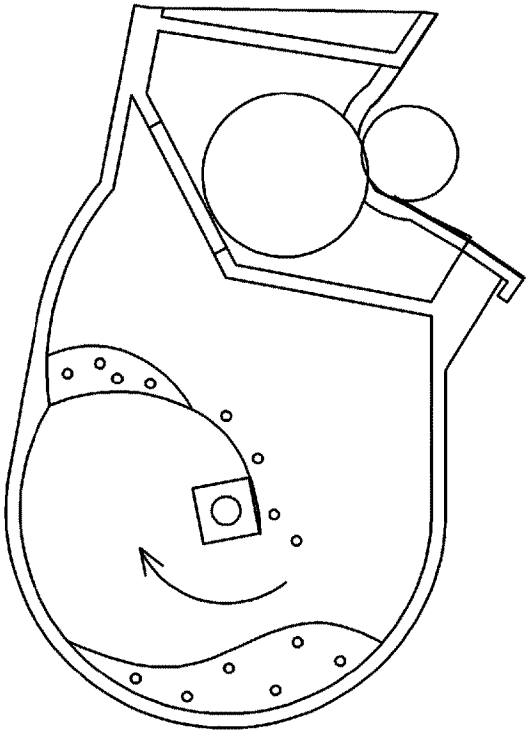

Then when the tip end of the stirring sheet 23*b* passes through the concave portion 18*d*, the gap N appears between the stirring sheet 23*b* and the concave portion 18*d*, as illustrated in FIG. 10C. According to Example 2, the stirring receive member 23*e* rotates while contacting the transport regulating surface 18*g*, and the stirring receive member 23*e* receives the toner that falls through the gap N, whereby a decrease in the toner amount laying on the stirring sheet 23*b* can be suppressed. Then, as illustrated in FIG. 10D, the tip end of the stirring sheet 23*b* passes through the concave portion 18*d*, and contacts the inner wall surface of the toner storing chamber 18*a*. At this time, the stirring assist member 23*c* suppress falling of the toner off the stirring sheet 23*b*, as in Example 1. Then, as illustrated in FIG. 10E, the tip end of the stirring sheet 23*b* passes through the release position 18*e*, and the stirring sheet 23*b* is restored from the bent state, whereby the toner on the stirring sheet 23*b* flips up toward the opening 18*c*.

As described above, according to Example 2, the stirring receive member 23*e* rotates while contacting the inner wall surface of the toner storing chamber 18*a* on the upstream side of the stirring sheet 23*b*, in a state in which the gap N appears between the inner wall surface of the concave portion 18*d* and the stirring sheet 23*b*. Thereby it can be suppressed that toner falling off the stirring sheet 23*b* through the gap N and drops into the base portion 18*f* of the toner storing chamber 18*a*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-212463, filed on Oct. 31, 2016, which is hereby incorporated by reference herein in its entirety.

What is claimed is:

1. A developer container, comprising:

a developer containing portion in which developer to be carried by a developer carrying member is stored;

a rotation shaft disposed in the developer containing portion;

a first sheet member installed on the rotation shaft in the developer containing portion and transporting the developer inside the developer containing portion to the developer carrying member located above the developer containing portion by rotating around the rotation shaft in a posture taken in use, the first sheet member elastically deforming to bend upon contacting an inner wall surface of the developer containing portion, and then being restored from the bent state upon releasing contact with the inner wall surface; and a second sheet member that is installed on the rotation shaft in the developer containing portion and rotates with the first sheet member, wherein one end of the first sheet member and one end of the second sheet member are fixed to the same position of the rotation shaft so that the second sheet member rotates with the first sheet member, and the other end of the first sheet member and the other end of the second sheet member are free ends, the other end of the second sheet member does not contact the inner wall surface of the developer containing portion when the rotation shaft rotates, and when the rotation shaft rotates in a state in which at least a part of the developer elevated by the first sheet member is positioned above the rotation shaft, the second sheet member rotates on the downstream side of the first sheet member in the rotating direction of the rotation shaft, so as to control falling of developer on the first sheet member.

2. The developer container according to claim 1, wherein the first sheet member, which has been elastically deformed, transports the developer inside the developer containing portion to the developer carrying member by flipping up the developer laying on the first sheet member using a restoring force, which is generated when the first sheet member is restored from the bent state.

3. The developer container according to claim 1, wherein in the posture taken in use, when the first sheet member is restored from the bent state, the other end of the first sheet member is located above the rotation shaft.

4. The developer container according to claim 3, wherein in the posture taken in use, when the first sheet member is restored from the bent state, the other end of the second sheet member is located above the highest position of the first sheet member.

5. The developer container according to claim 1, wherein the first sheet member has a greater length from one end, which is a fixed end, to the other end, which is a free end, than the second sheet member.

6. The developer container according to claim 1, wherein in the posture taken in use, the rotation shaft is disposed above a base portion of the developer containing portion, and the developer carrying member is disposed above the rotation shaft.

7. The developer container according to claim 1, wherein a third sheet member, which rotates with the first sheet member and the second sheet member, is installed on the rotation shaft.

8. The developer container according to claim 1, wherein the developer carrying member is disposed in a developing chamber, the inside of the developer containing portion communicates with the developing chamber via an opening, and a rotation radius of the first sheet member is smaller than a maximum value of a distance from an inner edge of the opening to the rotation shaft, and is greater than a minimum value of the distance from the inner edge of the opening to the rotation axis.

9. The developer container according to claim 8, wherein the first sheet member has a greater width than the opening in an extending direction of the rotation shaft.

10. The developer container according to claim 1, wherein the first sheet member and the second sheet member are made of resin.

11. The developer container according to claim 1, wherein the first sheet member and the second sheet member each have a thickness of 400 μm or less.

12. A developing apparatus, comprising:

the developer container according to claim 1; and a developer carrying member that carries developer, wherein an electrostatic latent image formed on an image bearing member is developed by the developer carried on the developer carrying member.

13. A process cartridge that is attachable to and detachable from a main body of an image forming apparatus, comprising:

the developer container according to claim 1;

a developer carrying member that carries developer; and an image bearing member on which an electrostatic latent image is formed, wherein the electrostatic latent image formed on the image bearing member is developed as a developer image by the developer carried on the developer carrying member.

14. An image forming apparatus, comprising:
the developer container according to claim 1;
a developer carrying member that carries developer; and
an image bearing member on which an electrostatic latent image is formed, wherein
the electrostatic latent image formed on the image bearing member is developed as a developer image by the developer carried on the developer carrying member, and
an image is formed on a recording medium from the developer image formed on the image bearing member.

15. A developer container comprising:
a developer containing portion in which developer to be carried by a developer carrying member is stored;
a rotation shaft disposed in the developer containing portion;
a first sheet member installed on the rotation shaft in the developer containing portion and transporting the developer inside the developer containing portion to the developer carrying member located above the developer containing portion by rotating around the rotation shaft in a posture taken in use, the first sheet member elastically deforming to bend upon contacting an inner wall surface of the developer containing portion, and then being restored from the bent state upon releasing contact with the inner wall surface; and
a second sheet member installed on the rotation shaft in the developer containing portion and rotating with the first sheet member,
a third sheet member installed on the rotation shaft in the developer containing portion and rotating with the first and second sheet members,
one end of the first sheet member, one end of the second sheet member, and one end of the third sheet member are fixed to the same position of the rotation shaft so that both the second sheet member and the third sheet member rotate with the first sheet member,
wherein when the rotation shaft rotates in a state in which at least a part of the developer elevated by the first sheet member is positioned above the rotation shaft, the second sheet member rotates on the downstream side of the first sheet member in the rotating direction of the rotation shaft, so as to control falling of developer on the first sheet member.

16. The developer container according to claim 15, wherein
the first sheet member, which has been elastically deformed, transports the developer inside the developer containing portion to the developer carrying member by flipping up the developer laying on the first sheet member using a restoring force, which is generated when the first sheet member is restored from the bent state.

17. The developer container according to claim 15, wherein
the second sheet member is configured such that the other end of the second sheet member does not contact the inner wall surface of the developer containing portion.

18. The developer container according to claim 15, wherein
in the posture taken in use, when the first sheet member is restored from the bent state, the other end of the first sheet member is located above the rotation shaft.

19. The developer container according to claim 18, wherein
in the posture taken in use, when the first sheet member is restored from the bent state, the other end of the second sheet member is located above the highest position of the first sheet member.

20. The developer container according to claim 15, wherein
the first sheet member has a greater length from one end, which is a fixed end, to the other end, which is a free end, than the second sheet member.

21. The developer container according to claim 15, wherein
in the posture taken in use, the rotation shaft is disposed above a base portion of the developer containing portion, and the developer carrying member is disposed above the rotation shaft.

22. The developer container according to claim 15, wherein
the developer carrying member is disposed in a developing chamber,
the inside of the developer containing portion communicates with the developing chamber via an opening, and
a rotation radius of the first sheet member is smaller than a maximum value of a distance from an inner edge of the opening to the rotation shaft, and is greater than a minimum value of the distance from the inner edge of the opening to the rotation axis.

23. The developer container according to claim 22, wherein
the first sheet member has a greater width than the opening in an extending direction of the rotation shaft.

24. The developer container according to claim 15, wherein
the first sheet member and the second sheet member are made of resin.

25. The developer container according to claim 15, wherein
the first sheet member and the second sheet member each have a thickness of 400 μm or less.

26. A developing apparatus, comprising:
the developer container according to claim 15; and
a developer carrying member that carries developer, wherein
an electrostatic latent image formed on an image bearing member is developed by the developer carried on the developer carrying member.

27. A process cartridge that is attachable to and detachable from a main body of an image forming apparatus, comprising:
the developer container according to claim 15;
a developer carrying member that carries developer; and
an image bearing member on which an electrostatic latent image is formed, wherein
the electrostatic latent image formed on the image bearing member is developed as a developer image by the developer carried on the developer carrying member.

28. An image forming apparatus, comprising:
the developer container according to claim 15;
a developer carrying member that carries developer; and
an image bearing member on which an electrostatic latent image is formed, wherein
the electrostatic latent image formed on the image bearing member is developed as a developer image by the developer carried on the developer carrying member, and
an image is formed on a recording medium from the developer image formed on the image bearing member.

* * * * *